US006024010A

United States Patent [19]

Kato et al.

[11] Patent Number: 6,024,010

[45] Date of Patent: Feb. 15, 2000

[54] SHOE FOR SWASH PLATE TYPE COMPRESSOR AND SHOE ASSEMBLY

[75] Inventors: Yoshio Kato; Tadahisa Tanaka, both of Iwata, Japan

[73] Assignee: NTN Corporation, Osaka-fu, Japan

[21] Appl. No.: 09/106,187

[22] Filed: Jun. 29, 1998

[30] Foreign Application Priority Data

Aug. 1, 1997 [JP] Japan ..... 9-207798
Aug. 1, 1997 [JP] Japan ..... 9-207970

[51] Int. Cl.[7] ..... F01B 3/00

[52] U.S. Cl. ..... 92/71; 91/499

[58] Field of Search ..... 92/71; 91/499; 417/269

[56] References Cited

U.S. PATENT DOCUMENTS

| | | | |
|---|---|---|---|
| 3,943,828 | 3/1976 | Wagenseil | 91/499 |
| 4,263,814 | 4/1981 | Takaoka et al. | 74/60 |
| 4,464,157 | 8/1984 | Futamura et al. | 92/71 |
| 4,617,856 | 10/1986 | Miller et al. | 92/71 |
| 4,662,267 | 5/1987 | Kaku et al. | 92/71 |
| 4,683,803 | 8/1987 | Miller et al. | 92/71 |
| 4,734,014 | 3/1988 | Ikeda et al. | 417/269 |
| 4,752,191 | 6/1988 | Onomura et al. | 417/269 |
| 5,114,261 | 5/1992 | Sugimoto et al. | 417/269 X |
| 5,896,803 | 4/1999 | Sugawara et al. | 92/71 X |
| 5,943,941 | 8/1999 | Kato et al. | 92/71 X |

FOREIGN PATENT DOCUMENTS

| | | | |
|---|---|---|---|
| 1451337 | 1/1989 | Russian Federation | 91/499 |

*Primary Examiner*—John E. Ryznic
*Attorney, Agent, or Firm*—Nikaido, Marmelstein, Murray & Oram LLP

[57] ABSTRACT

Contact between the top portion and the spherical seat of the piston is avoided through a simple arrangement and even if the swash plate angle is increased, a suitable contact portion is obtained. To this end, the top portion of a shoe for swash plate type compressors is composed of a partial spherical surface having a larger radius of curvature than that of the outer peripheral surface which contacts a seat surface formed in the piston, the top portion being smoothly continuous with the outer peripheral surface. Further, the generatrix of the outer peripheral surface of the shoe in contact with the seat surface is an arc whose center of curvature is radially spaced from the centerline of the shoe and whose radius of curvature is shorter than that of the seat surface, whereby the outer peripheral surface of the shoe contacts the seat surface of the piston at a predetermined position; this makes it easier to control the contact of the shoe for swash plate type compressors.

7 Claims, 3 Drawing Sheets

SHOE FOR SWASH PLATE TYPE COMPRESSOR AND SHOE ASSEMBLY

BACKGROUND OF THE INVENTION

1. Technical Field

This invention relates to a shoe for swash plate type compressors used for automobile air conditioners and a shoe assembly.

2. Prior Art

A swash plate type compressor, as schematically shown in FIG. 7, includes a rotary shaft 3 rotatably supported in a pair of cylinder blocks 5*a*, 5*b*, said rotary shaft 3 having a swash plate 2 fixed thereon. The cylinder blocks 5*a*, 5*b* are formed with a plurality of circumferentially equispaced cylinder bores 5, each bore 5 having a double ended piston 4 slidably received therein. Each piston 4 is centrally formed with a recess 4*a* in such a manner as to straddle the outer periphery of the swash plate 2, said recess 4*a* having spherical seats 4*b* formed at the axially opposite surfaces thereof. A shoe 1 is received in each spherical seat 4*b* and interposed between the swash plate 2 and the piston 4, serving to smoothly transform the rotary motion of the swash plate 2 into the reciprocating motion of the piston 4. While the double acting type having double ended pistons has been taken up by way of example, the single acting type has basically the same construction.

The shoe 1 is generally hemispherical and engages the spherical seat 4*b* of the piston 4 through its spherical outer peripheral surface and slidably contacts the swash plate 2 through its flat bottom surface.

There has heretofore been known an arrangement wherein, as shown in FIGS. 8 and 9, of the spherical outer peripheral surface of the shoe 1, the contact portion which contacts the spherical seat 4*b* and the skirt portion are constructed with mutually different radii of curvature (see Japanese Patent Publication Hei 3-51912). FIGS. 8 and 9 show the spherical seat 4*b* of the piston 4 and the shoe 1 received therein, and the spherical seat 4*b* is defined by a single radius of curvature, while the spherical outer peripheral surface of the shoe 1 comprises a top reference surface 1*a* having substantially the same radius of curvature as the spherical seat 4*b* and a retracted spherical surface 1*b* formed by retracting the spherical band portion of the skirt from the reference spherical surface 1*a* toward the center of the shoe 1, said spherical band portion of the skirt repeating engagement with and disengagement from the spherical seat 4*b*. In other words, the curvature of the retracted spherical surface 1*b* differs from that of the reference spherical surface 1*a* and furthermore the respective curvatures of the various portions of the retracted spherical surface 1*b* gradually change, which means that the outer peripheral surface of the shoe 1 has a plurality of curvatures. As a result, a suitable clearance which gradually increases from the boundary between the retracted spherical surface 1*b* and the reference spherical surface 1*a* variously changes its size according to the swing movement of the shoe 1 and assists in the wedge action, enabling effective feeding of lubricating oil to the contact region of the sliding reference spherical surface 1*a*.

In swash plate type compressors, the shoe is forced to perform the so-called precession according to the rotary swing movement of the swash plate, a fact which is liable to cause local contact, which, in turn, causes other drawbacks, such as local wear. Therefore, in order to ensure correct contact of the shoe, it is necessary to control the shoe during the manufacture thereof so that the position of contact of the shoe is within a predetermined range.

In the case where the outer peripheral surface of the shoe which contacts the spherical seat of the piston has substantially the same radius of curvature as that of the spherical seat, the position of contact tends to vary rather than remain unchanged. Furthermore, the position of contact of the shoe with the spherical seat is influenced by the quality of finish of the spherical surface of the shoe, a fact which makes it difficult to control the height of the shoe. Further, in the case where the outer peripheral surface of the shoe is defined by aplurality of curvatures, it is difficult to process the shoe and the position of contact of the shoe with the spherical seat of the piston is more liable to vary.

SUMMARY OF THE INVENTION

Accordingly, an object of the present invention is to avoid contact between the top portion of the shoe and the spherical seat of the piston and secure a contact portion which remains suitable even if the angle of the swash plate is increased.

To achieve said object, a shoe for swash plate type compressors according to this invention comprises outer peripheral surface of single radius of curvature which contacts the spherical seat of the piston and a flat slide contact surface which contacts the swash plate, the top portion of the shoe being defined by a partial spherical surface having a larger radius of curvature than that of the spherical seat. The term "slightly larger" used herein refers to "larger than the radius of curvature $R_1$ of the outer peripheral surface 14 but not as large as the so-called crowning".

The outer peripheral surface which contacts the spherical seat is defined by a single curvature, the radius of curvature thereof being equal to or slightly smaller than that of the spherical seat. Alternatively, the outer peripheral surface may be formed by a curved surface whose generatrix is an arc having a center of curvature at a position radially spaced from the centerline of the shoe. In this case also, the outer peripheral surface is of single curvature.

The inner peripheral surface of the spherical seat is of single curvature, that is, it is a truly spherical surface. However, it may be such a curved surface that only the region which comes into contact with the shoe is of single curvature with the radius of curvature gradually increasing as the end portion of the opening is approached.

Since the shoe for swash plate type compressors according to this invention has a top portion which is formed by a partial spherical surface having a larger radius of curvature than that of the outer peripheral surface of the shoe which contacts the spherical seat of the piston, the outer peripheral surface and the top portion are smoothly continuous with each other, so that there is no danger of edge contact. Furthermore, the top portion does not contact the spherical seat and defines a minute clearance of crescent cross section between it and the spherical seat. This minute clearance of crescent cross section functions as an oil reservoir, a fact which, synergistically coupled with the fact that the top portion and the outer peripheral surface are smoothly continuous with each other, as described above, ensures that the lubrication between the shoe and the piston is extremely satisfactorily effected.

Since the top portion of the shoe does not contact the spherical seat of the piston, the contact start portion can be easily controlled and a contact portion which is optimum to satisfy the required design specifications can be attained. Since the outer peripheral surface of the shoe which contacts the spherical seat of the piston is defined by a single radius of curvature, a larger area of contact can be obtained. Therefore, even if the swash plate angle is increased, the necessary contact portion can be obtained.

Further, since the shoe for swash plate type compressors according to this invention has its outer peripheral surface defined by a single curvature, it is easy to process, making it possible to inexpensively produce a shoe having highly accurate outer peripheral surface for swash plate type compressors. Since a contact portion can be constructed which is suitable as compared with a conventional one having a radius of curvature which is decreased as the slide contact surface is approached, the securement of a contact portion is easy, making it possible to provide a suitable shoe which satisfies specifications for high loads, etc.

Another object of this invention is to provide a shoe for swash plate type compressors, which allows easy control of contact and which is easy to process.

To achieve said object, this invention provide a shoe for swash plate type compressors, wherein the seat surface formed on the piston is spherical (spherical seat) and the generatrix of the outer peripheral surface of the shoe is an arc whose center of curvature is located at a position radially spaced from the centerline of the shoe and whose radius of curvature is smaller than that of the seat surface. In other words, the position at which the shoe contacts the piston is provided with a range so that the contact reliably occurs within said range and within the tolerance of the diameter of the spherical surface. This ensures that the outer peripheral surface of the shoe contacts the piston always at a fixed point. Therefore, the control of the contact of the shoe is facilitated. Since the position of contact can be accurately determined by the center of curvature and radius of curvature, it is possible to adjust the contact area and contact diameter and realize an optimum design which satisfies specifications for high speed, high loads, etc.

As a result of the arrangement wherein the outer peripheral surface of the shoe has a generatrix which is an arc whose center of curvature is located at a position radially spaced from the centerline of the shoe and whose radius of curvature is smaller than that of the seat surface, as described above, the top portion of the shoe is formed with a recess. This recess functions as an oil reservoir. Further, since the radius of curvature of the generatrix of the outer peripheral surface of the shoe is smaller than that of the seat surface and since the outer peripheral surface of the shoe contacts the piston at a fixed point, there is defined a wedge-shaped clearance between the two which gradually spreads from the contact point. This wedge-shaped clearance functions to draw oil into the space between the two. Therefore, the respective actions of said recess and wedge-shaped clearance cooperate with each other to effect lubrication between the shoe and the piston extremely satisfactorily.

Further, the shoe assembly for swash plate type compressors according to this invention is so designed that a shoe as assembled in the seat surface formed in piston has an amount of projection from the controlled piston. As a result, stated in more detail, the seat surface is made spherical and the generatrix of the outer peripheral surface of the shoe is an arc whose center of curvature is located at a position radially spaced from the centerline of the shoe and whose radius of curvature is smaller than that of the seat surface or the seat surface is made conical while the outer peripheral surface of the shoe is made spherical. This ensures that the seat surface and the outer peripheral surface of the shoe contact each other always at a fixed point; thus, the amount of projection of the shoe from the piston can be controlled so that it is at a predetermined value.

In the shoe for swash plate type compressors according to this invention, since the generatrix of the outer peripheral surface of the shoe which contacts the spherical seat of the piston is an arc whose center of curvature is located at a position radially spaced from the centerline of the shoe and whose radius of curvature is smaller than that of the seat surface, it follows that the outer peripheral surface of the shoe contacts the spherical seal at a predetermined position. Therefore, the control of the contact of the shoe is facilitated.

Further, since the outer peripheral surface of the shoe contacts the piston at a predetermined position, there is defined a wedge-shaped clearance between the two which gradually spreads from the contact point. The said wedge-shaped clearance is in a form which is advantageous for drawing oil and advantageously acts for lubrication between the shoe and the piston. In addition, as a result of the arrangement wherein the outer peripheral surface of the shoe has a generatrix which is an arc whose center of curvature is located at a position radially spaced from the centerline of the shoe and whose radius of curvature is smaller than that of the recess in the piston, as described above, the top portion of the shoe is formed with a recess. Since this recess functions as an oil reservoir, it acts synergistically with said wedge-shaped clearance to effect lubrication between the shoe and the piston extremely satisfactorily.

Further, since the shoe for swash plate type compressors according to this invention has its outer peripheral surface defined by a single curvature, it can be easily processed, a fact which, coupled with the fact that the control of the contact is facilitated, makes it possible to inexpensively produce a shoe having highly accurate outer peripheral surface for swash plate type compressors.

DESCRIPTION OF THE PREFERRED EMBODIMENTS

Figure 1:
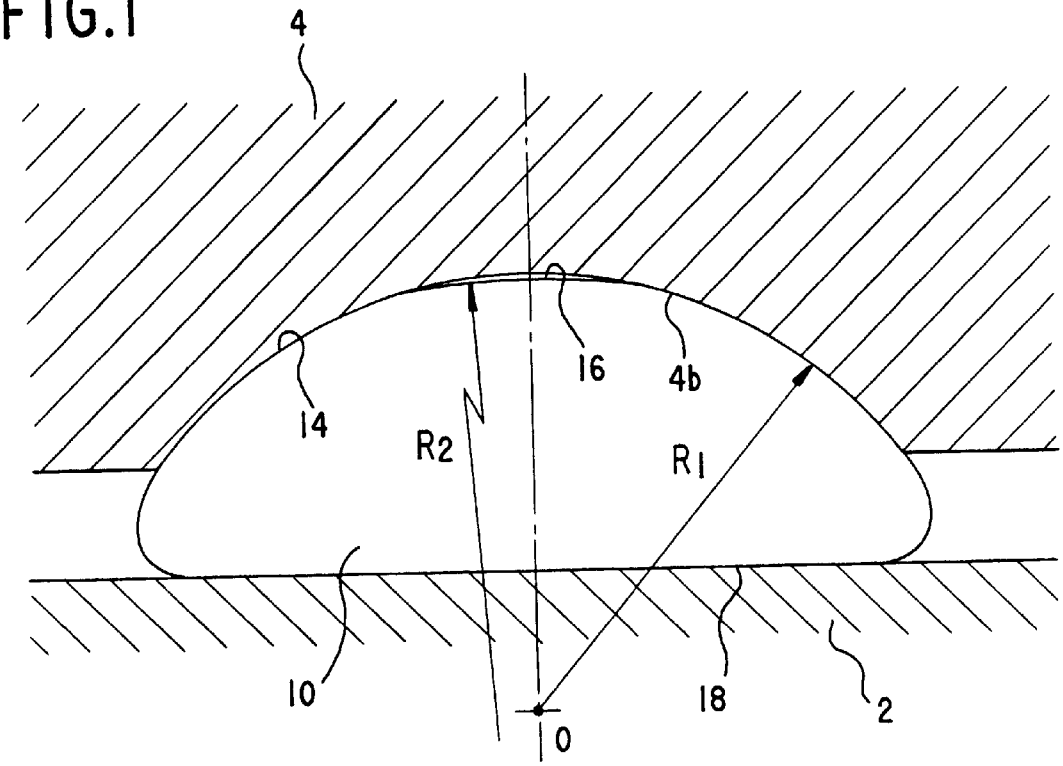
FIG. 1 is a longitudinal section of a shoe abutting against the spherical seat of a piston.
Figure 8:
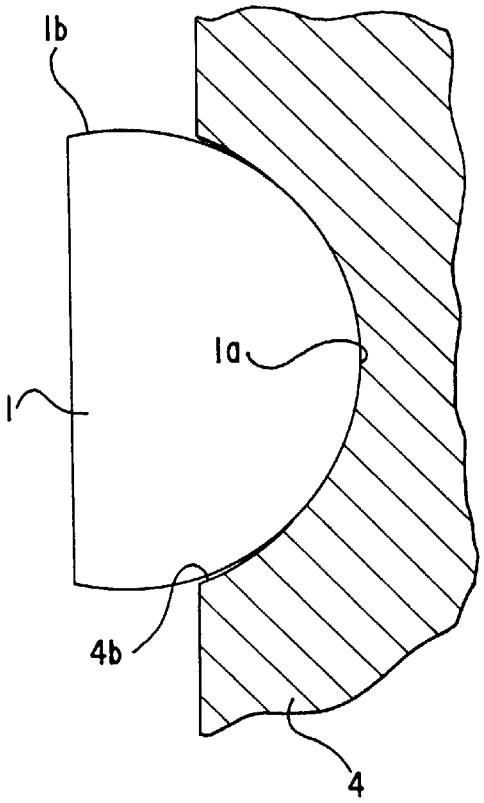
FIGS. 8 and 9 are sectional views showing the prior art.
Figure 9:
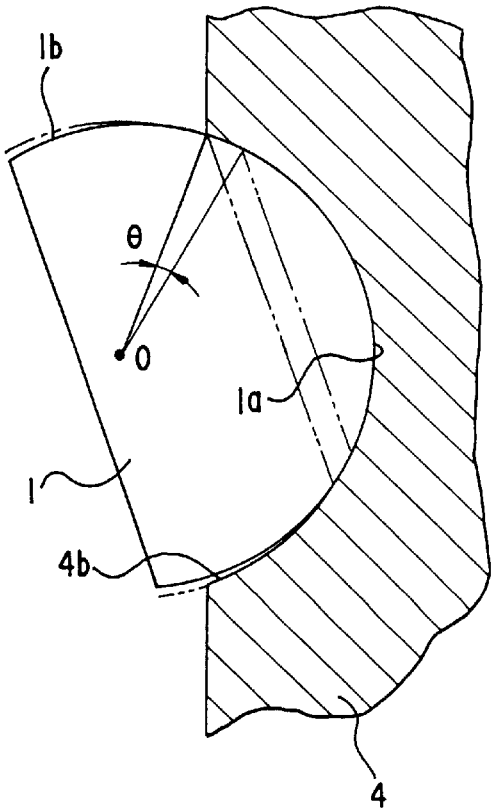

As shown in FIG. 1, a shoe 10 is made of a steel ball by die forging and is in the form of a hemisphere or button. The outer peripheral surface 14 which contacts the spherical seat 4*b* of a piston 4 is formed by a spherical surface having a radius of curvature $R_1$ which is equal to or slightly smaller than that of the spherical seat 4*b*. Since the outer peripheral surface 14 is of single curvature, it is very easy to process as compared with the one having a plurality of curvatures described above with reference to FIGS. 8 and 9, so that its contact can be accurately determined.

The top portion 16 of a shoe 10 is formed by a partial spherical surface having a radius of curvature $R_2$ which is larger than that $R_1$ of the outer peripheral surface 14. Further, the radius of curvature $R_2$ of the top portion 16 is larger than the radius of curvature $R_1$ of the spherical seat 4*b* of the piston and is set to a value to provide optimum contact with the spherical seat 4*b*.

As a result of the top portion 16 being formed by a partial spherical surface of the curvature described above, its connection to the outer peripheral surface 14 is smooth as compared with the case where it is a flat surface perpendicular to the centerline 12. Therefore, there is no danger of the shoe 10 edgewise contacting the spherical seat 4*b*. Further, the top portion 16 never contacts the spherical seat 4*b* and thus defines a minute crescent (as seen in section) clearance 17 between it and the spherical seat 4*b*. This minute clearance 17 functions as an oil reservoir, and lubricating oil is fed from the peripheral edge thereof into the space between the outer peripheral surface 14 and the spherical seat 4*b*.

In addition, the top portion 16 may be additionally formed with a countersink, groove or other recess to enhance the oil retaining function.

Figure 7:
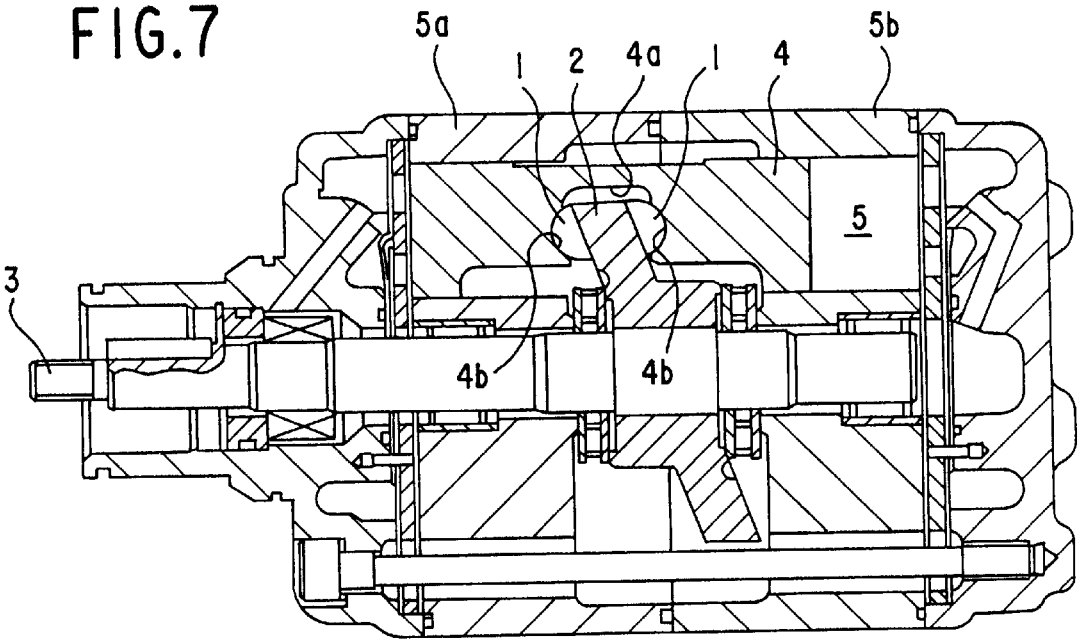
FIG. 7 is a longitudinal section of a swash plate type compressor.

The slide contact surface 18 of the shoe 10 which contacts the swash plate 2 (see FIG. 7) is flat, and connects with the outer peripheral surface 14 via a curved surface 19 of relatively small radius of curvature. In addition, it is not absolutely necessary for the slide contact surface 18 to be a flat surface perpendicular to the centerline 12; for example, it may be a convex spherical surface of large curvature or a crown surface with the middle region gently raised relative to the peripheral region. However, the flat surface is the most advantageous from the viewpoint that the processing is easier. In addition, the slide contact surface 18 may be formed with a hole, groove or other oil reservoir recess.

Figure 2:
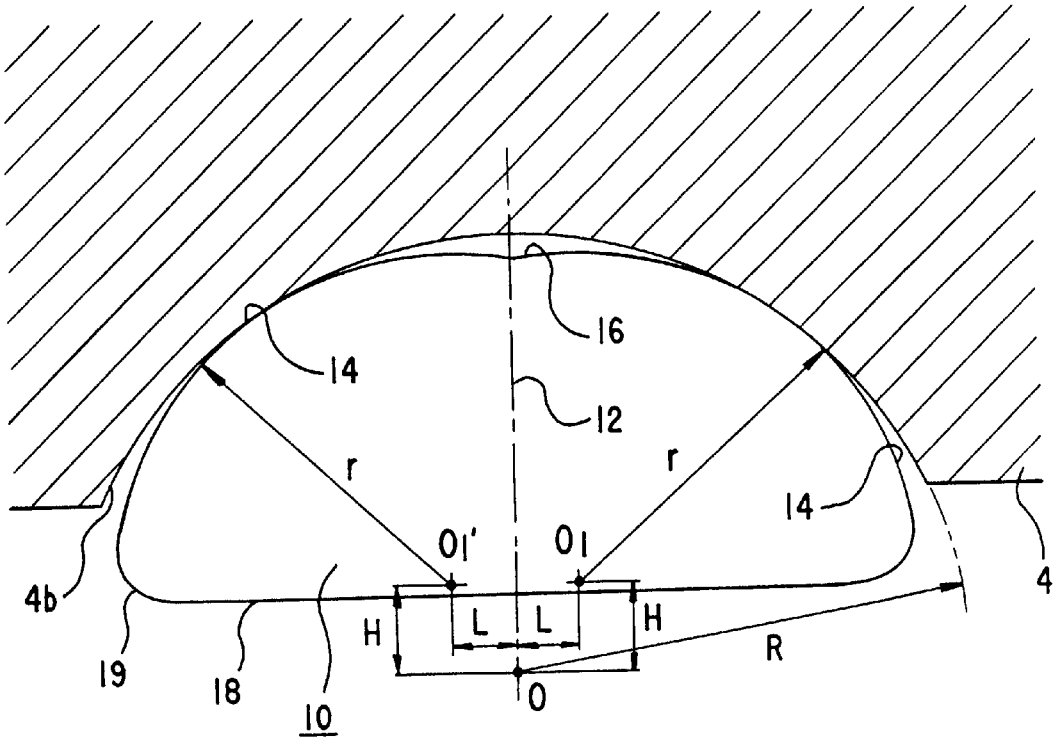
FIG. 2 is a longitudinal section similar to FIG. 1, showing another embodiment.

FIG. 2 shows another embodiment wherein the outer peripheral surfaces 14 of the shoe 10 are each formed by a curved surface having a generatrix in the form of an arc whose center of curvature $O_1$, $O_1'$ is radially spaced from the centerline 12 of the shoe 10. The radius of curvature r is arranged so that it is shorter than that $R_1$ of the spherical seat 4*b*. More specifically, the center of curvature $O_1$, $O_1'$ of the outer peripheral surface 14 is spaced by a distance L radially outwardly and by a distance H axially from the center of curvature O of the spherical seat 4*b*. Therefore, it follows that the outer peripheral surfaces 14 of the shoe 10, as seen in a longitudinal section (FIG. 2) contacts the spherical seat 4*b* of the piston 4 always at two points. The contacts points in question can be changed by changing the centers of curvature $O_1$, $O_1'$ and the radius of curvature r. in this case also, since the outer peripheral surfaces 14 are of single curvature, the processing is very easy as compared with the case of a plurality of curvatures described above with reference to FIGS. 8 and 9 and the points of contact can be accurately determined.

In that the generatrix of the outer peripheral surfaces 14 of the shoe 10 is in the form of an arc as described above, there is a recess formed in the top potion 16 of the shoe 10. Since this top portion 16 never contacts the spherical seat 4*b* of the piston 4, it can be effectively used as an oil reservoir. As a geometrical result of the generatrix of the outer peripheral surfaces 14 of the shoe 10 being in the form of an arc as described above, an oil reservoir is formed in the top portion of the shoe 10 without having to specially drilling a hole in the top portion for an oil reservoir; it goes without saying that this statement does not exclude the addition of a hole, groove or other recess.

Instead of shaping the outer peripheral surfaces 14 of the shoe 10 to have a longitudinal section which makes contact at two points, the inner peripheral surface of the spherical seat 4*b* of the piston 4 may be changed into, for example, a conical surface, whereby shoe contact of at two points can be realized. In that case, the generatrix of the conical surface is not limited to a straight line but it may be a convex circular arc or concave circular arc, the latter case resulting in a Gothic arch type longitudinal sectional form.

Figure 3:
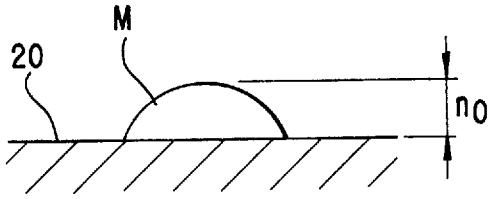
FIG. 3 is a side view of a masterpiece.
Figure 4:
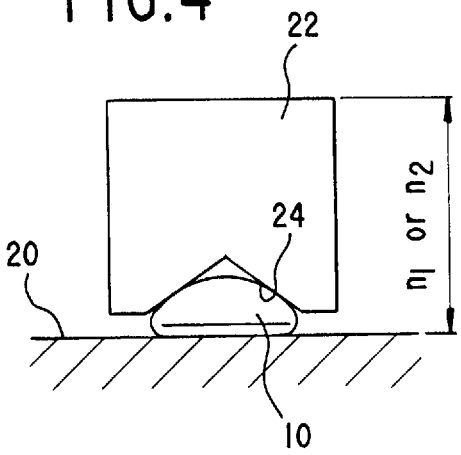
FIG. 4 is an explanatory view showing a measuring method.

Control of contact of the shoe 10 is made on the basis of the "height" of the shoes found in the following manner. As shown in FIGS. 3 and 4, a masterpiece M finished to a predetermined curvature and height $h_0$ is placed on a surface plate 20 and then a jig 22 having a conical recess 24 of predetermined conical angle is placed thereon, and the distance (or the master assembly height $h_1$) from the surface plate 20 to the upper surface of the jig 22 is measured. Then, the shoe 10 is placed on the surface plate 20 and the jig 22 is placed thereon, and the distance (or the shoe assembly height $h_2$) from the surface plate 20 to the upper surface of the jig 22 is measured. And the height H of the shoe 10 to be found is calculated from the following formula.

$$H=h_0+(h_2-h_1)$$

Figure 5:
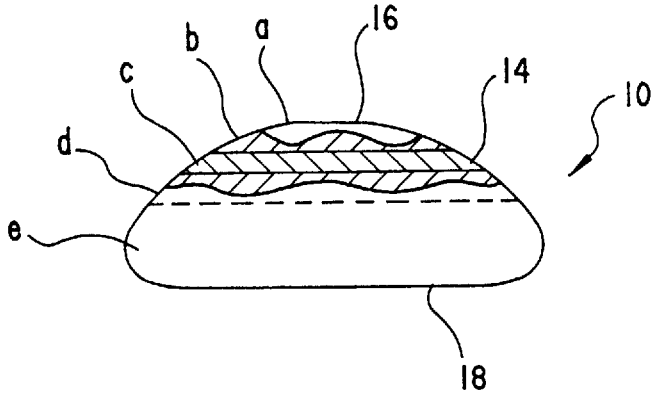
FIG. 5 is a schematic side view for explaining the contact of the shoe.
Figure 6:
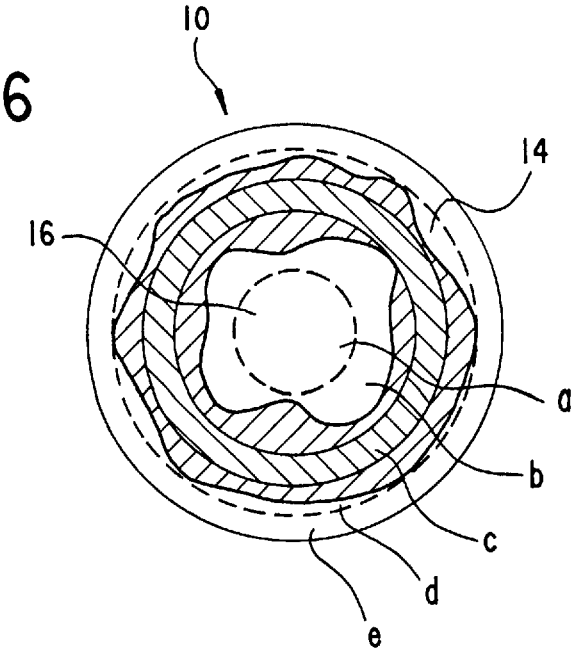
FIG. 6 is a schematic plan view.

The intended contact can be attained by controlling the height H of the shoe so that it falls within a predetermined range. In addition, if the outer peripheral surface 14 of the shoe 10 is divided into five regions a through e, as schematically shown in FIGS. 5 and 6, the point of contact with the spherical seat 4*b* corresponds to the region c. The regions b and d located above and below this region c are regions in which no local contact should be allowed to take place; however, continuous contact extending from the region c is allowed in these regions. In the region a of the top portion 16, no contact will take plate because of the difference in curvature from the spherical seat. The lowermost region e is also the region in which no contact should be allowed to take place.

What is claimed is:

1. A shoe for swash plate type compressors, characterized in that the shoe comprises an outer peripheral surface of single curvature which contacts the spherical seat of a piston, and a flat slide contact surface which contacts the wash plate, the top portion being formed by a partial spherical surface having a larger radius of curvature than that of the spherical seat.

2. A shoe for swash plate type compressors as set forth in claim 1, characterized in that radius of curvature of the outer peripheral surface is equal to or slightly smaller than that of the spherical seat.

3. A shoe for swash plate type compressors as set forth in claim 1, characterized in that the generatrix of the outer peripheral surface is an arc whose center of curvature is radially spaced from the centerline of the shoe.

4. A shoe for swash plate type compressors, characterized in that the generatrix of the outer peripheral surface of the shoe which contacts a spherical seat formed in a piston is an arc whose center of curvature is radially spaced from the centerline of the shoe and whose radius of curvature is shorter than that of the seat surface.

5. A shoe assembly for swash plate type compressors, characterized in that the shoe assembled in a seat surface formed in a piston has a controlled amount of projection from the piston.

6. A shoe assembly for swash plate type compressors as set forth in claim 5, characterized in that said seat surface is spherical and the generatrix of the outer peripheral surface of the shoe is an arc whose center of curvature is radially spaced from the centerline of the shoe and whose radius of curvature is shorter than that of the seat surface.

7. A shoe assembly for swash plate type compressors as set forth in claim 5, characterized in that said seat surface is conical and the outer peripheral surface of the shoe is spherical.

* * * * *